US008944353B2

(12) United States Patent
Sato et al.

(10) Patent No.: US 8,944,353 B2
(45) Date of Patent: Feb. 3, 2015

(54) METHOD FOR PRODUCING FRACTURED FRAGMENTS OF POLYCRYSTALLINE SILICON

(75) Inventors: Shigeru Sato, Misawa (JP); Motoki Sato, Naka-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 395 days.

(21) Appl. No.: 13/431,005

(22) Filed: Mar. 27, 2012

(65) Prior Publication Data

US 2012/0256023 A1 Oct. 11, 2012

(30) Foreign Application Priority Data

Apr. 5, 2011 (JP) ..... 2011-84063

(51) Int. Cl.
*B02C 25/00* (2006.01)
*B02C 4/08* (2006.01)
*B02C 23/12* (2006.01)

(52) U.S. Cl.
CPC .. *B02C 4/08* (2013.01); *B02C 23/12* (2013.01)
USPC ..... 241/30; 241/235

(58) Field of Classification Search
USPC ..... 241/30, 235
See application file for complete search history.

(56) References Cited

U.S. PATENT DOCUMENTS

| | | | | |
|---|---|---|---|---|
| 8,517,295 | B2 * | 8/2013 | Matsuzaki et al. | 241/187 |
| 2006/0070569 | A1 | 4/2006 | Andrejewski et al. | |
| 2006/0088970 | A1 | 4/2006 | Hesse et al. | |
| 2009/0114748 | A1 | 5/2009 | Gruebl et al. | |

FOREIGN PATENT DOCUMENTS

| | | | |
|---|---|---|---|
| JP | 2006-122902 | A | 5/2006 |
| JP | 2006-192423 | A | 7/2006 |
| JP | 2009-531172 | A | 9/2009 |

* cited by examiner

*Primary Examiner* — Faye Francis
(74) *Attorney, Agent, or Firm* — Edwards Wildman Palmer LLP

(57) ABSTRACT

A method for producing fractured fragments of polycrystalline silicon having a fracturing process fracturing fragments of polycrystalline silicon between a pair of rolls which are rotated in a counter direction each other around parallel axes, in which: the rolls have a plurality of fracturing teeth protruding radially-outwardly from outer peripheral surfaces thereof; the fracturing teeth have spherical top surfaces and conical or cylindrical side surfaces; the fracturing process is performed in fracturing ratio of equal to or more than 1.0 to less than 1.5, and the fracturing ratio is specified by a maximum length of polycrystalline silicon before fracturing with respect to a facing distance between the top surfaces of the fracturing teeth at a facing part of the rolls.

3 Claims, 7 Drawing Sheets

METHOD FOR PRODUCING FRACTURED FRAGMENTS OF POLYCRYSTALLINE SILICON

CROSS REFERENCE TO RELATED APPLICATIONS

This application is related to five applications, all of them entitled, "APPARATUS FOR FRACTURING POLYCRYSTALLINE SILICON AND METHOD FOR PRODUCING FRACTURED FRAGMENTS OF POLYCRYSTALLINE SILICON" filed as follows: Ser. No. 13/282,704 filed Oct. 27, 2011 in the names of Takahiro Matsuzaki, Teruyoshi Komura, Shunsuke Kotaki and Motoki Sato; Ser. No. 13/282,676 filed Oct. 27, 2011 in the names of Takahiro Matsuzaki and Shunsuke Kotaki; Ser. No. 13/282,620 filed Oct. 27, 2011 in the names of Ryusuke Tada, Takahiro Matsuzaki, Shunsuke Kotaki and Motoki Sato; Ser. No. 13/282,551 filed Oct. 27, 2011 in the names of Ryusuke Tada and Motoki Sato; and Ser. No. 13/282,523 filed Oct. 27, 2011 in the names of Ryusuke Tada and Motoki Sato; which applications are assigned to the assignee of the instant application.

BACKGROUND OF THE INVENTION

1. Field of the Invention

The present invention relates to a method for producing fractured fragments of polycrystalline silicon which is raw material of semiconductor silicon or the like into fragments.

Priority is claimed on Japanese Patent Application No. 2011-84063, filed Apr. 5, 2011, the content of which is incorporated herein by reference.

2. Description of Related Art

A silicon wafer which is used for a semiconductor chip is manufactured from single-crystal silicon which is produced by, for example, Czochralski method ("CZ method"). For producing single-crystal silicon by the CZ method, for example, fractured fragments of polycrystalline silicon that is obtained by fracturing rod-shaped polycrystalline silicon formed by Siemens process is used.

For fracturing polycrystalline silicon, as shown in FIG. 7, a rod R of polycrystalline silicon is fractured to fragments C of a few millimeters to a few centimeters. In this process, it is typical to break the rod R into appropriate size by thermal shock or the like, and then further hit and break the fragments with a hammer directly. However, the process strains workers, and it is inefficient to obtain fragments of appropriate size from rod-shaped polycrystalline silicon.

In Japanese Unexamined Patent Application, First Publication No. 2006-122902 (Patent Document 1), a method for obtain silicon fragments by fracturing rod-shaped polycrystalline silicon with a roll-crasher is disclosed. The roll-crasher is a single-roll crasher in which one roll is stored in a housing and a plurality of teeth are formed on a surface of the roll. The roll-crasher fractures the rod-shaped polycrystalline silicon by collapsing between the teeth and an inner surface of the housing so as to impact the polycrystalline silicon continuously.

On the other hand, in Published Japanese Translation No. 2009-531172 of the PCT International Publication (Patent Document 2) and Japanese Unexamined Patent Application, First Publication No. 2006-192423 (Patent Document 3), apparatuses for fracturing roughly-crashed fragments of polycrystalline silicon are proposed. These apparatuses are double-roll crashers having two rolls and crashing the roughly-crashed fragments of polycrystalline silicon between the rolls.

SUMMARY OF THE INVENTION

Problems to be Solved by the Invention

A maximum target size of the fractured fragments obtained from the roll crasher is set as a gap between the roll and the inner surface of the housing of the roll crasher in the Patent Document 1. Also, maximum target sizes of the fractured fragments obtained from the roll crashers are set as gaps between the rolls of the roll crashers in the Patent Documents 2 and 3. However, the fractured fragments of polycrystalline silicon are crammed into the gap between the roll and the inner surface of the housing or the gap between the rolls and are ground, so that a rate of powder of polycrystalline silicon is increased. Therefore, an efficiency of polycrystalline silicon fracturing into desired size is deteriorated.

The present invention is contrived in view of the circumstances, and an object of the present invention is to provide a method for producing fractured fragments of polycrystalline silicon in which the maximum target size of fragments of polycrystalline silicon can be controlled by fracturing into desired size with preventing powder from being generated.

Means for Solving the Problem

A method for producing fractured fragments of polycrystalline silicon of the present invention having a fracturing process fracturing fragments of polycrystalline silicon between a pair of rolls which are rotated in a counter direction each other around parallel axes, in which: the rolls have a plurality of fracturing teeth protruding radially-outwardly from outer peripheral surfaces thereof; the fracturing teeth have spherical top surfaces and conical or cylindrical side surfaces; the fracturing process is performed in fracturing ratio of equal to or more than 1.0 to less than 1.5, and the fracturing ratio is specified by a maximum length of polycrystalline silicon before fracturing with respect to a facing distance between the top surfaces of the fracturing teeth at a facing part of the rolls.

In the method for producing fractured fragments of polycrystalline silicon, polycrystalline silicon can be fractured efficiently by continuously being impacted by the fracturing teeth while rolling the rolls. The top surfaces of the fracturing teeth are formed spherically, so that the top surfaces of the fracturing teeth and polycrystalline silicon are in contact at points. Furthermore, the side surfaces of the fracturing teeth are formed cylindrically, so that the side surfaces of the fracturing teeth and polycrystalline silicon are in contact in lines. Therefore, since the fracturing teeth and polycrystalline silicon are in contact at points or in lines, polycrystalline silicon can be prevented from being ground into powder by the fracturing teeth. Furthermore, by setting the fracturing ratio to the above extent, polycrystalline silicon can be prevented from being ground excessively, so that the powder is prevented from being generated and the fragments having suitable size can be produced.

The method for producing fractured fragment of polycrystalline silicon according to the present invention performs the plurality of fracturing processes and further has a sorting process sorting the fractured fragments of polycrystalline silicon obtained by the fracturing process by size between the fracturing processes, in which the large fractured fragments of polycrystalline silicon sorted by the sorting process are fractured by the fracturing process following the sorting process.

In the fracturing processes, since the fracturing ratios are set in a range of equal to or more than 1.0 to less than 1.5, the powder can be prevented from being generated. Furthermore, the size of the fractured fragments of polycrystalline silicon can be approximated to desired size progressively at every fracturing process with preventing generation of powder, so that a generation rate of fine fragments can be prevented and conversion efficiency to the desired size of the fractured fragments of polycrystalline silicon can be improved.

In the method of producing fractured fragments of polycrystalline silicon according to the present invention, it is preferable that in each of the fracturing processes, diameters and protruding heights of the fracturing teeth and gaps between the adjacent fracturing teeth be adjusted in accordance with the facing distance of the fracturing teeth.

The fractured fragments of polycrystalline silicon can be fractured with preventing the generation of powder by adjusting the sizes and arrangements of the fracturing teeth in accordance with the facing distance between the fracturing teeth of the rolls.

Effects of the Invention

According to the method of producing fractured fragments of polycrystalline silicon, polycrystalline silicon can be fractured into the desired size with controlling the maximum target size, and the generation of powder by fracturing can be prevented.

DESCRIPTION OF THE PREFERRED EMBODIMENTS

Hereinafter, an embodiment of a method for producing fractured fragments of polycrystalline silicon according to the present invention will be described.

Figure 1:
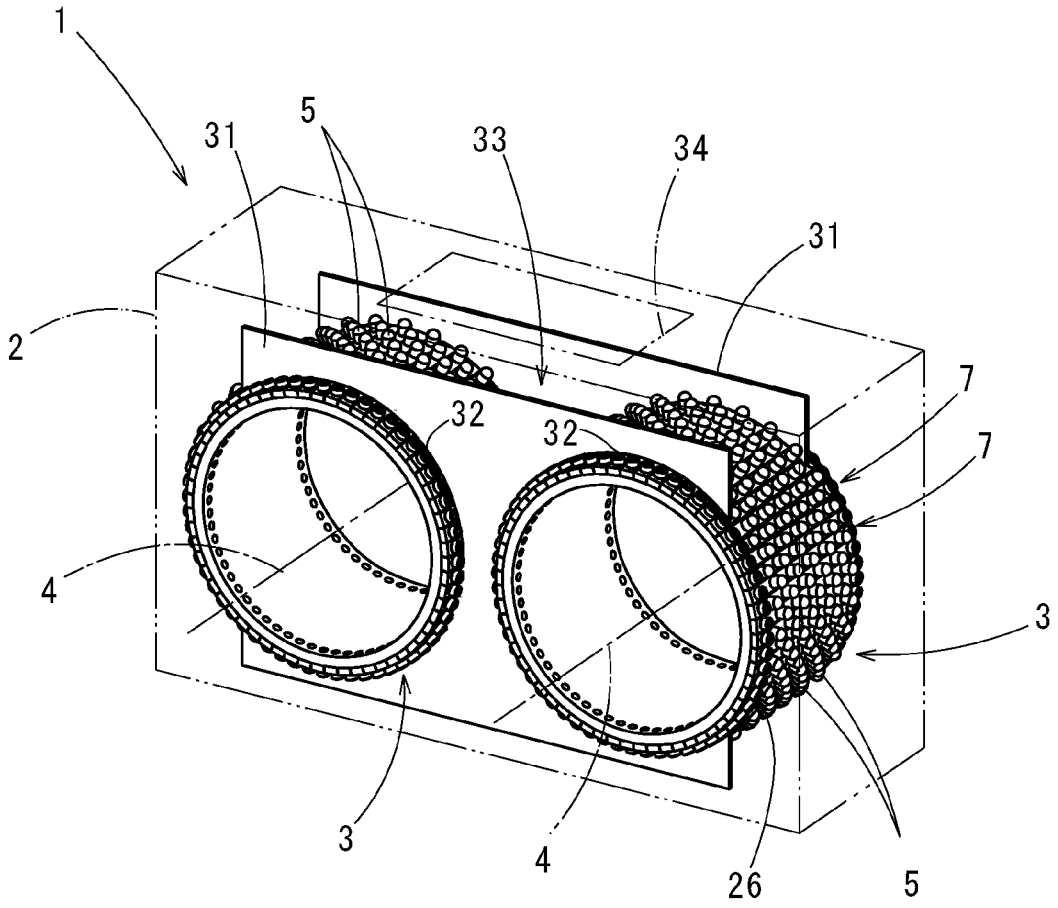
FIG. 1 is a perspective view showing a part of a fracturing apparatus of an embodiment in which a method for producing fractured fragments of polycrystalline silicon according to the present invention is applied.

A method for producing fractured fragments of polycrystalline silicon of a first embodiment has a fracturing process fracturing fragments of polycrystalline silicon between a pair of rolls which are rotated in a counter direction each other around parallel axes by a fracturing apparatus 1 shown in FIG. 1.

Figure 2:
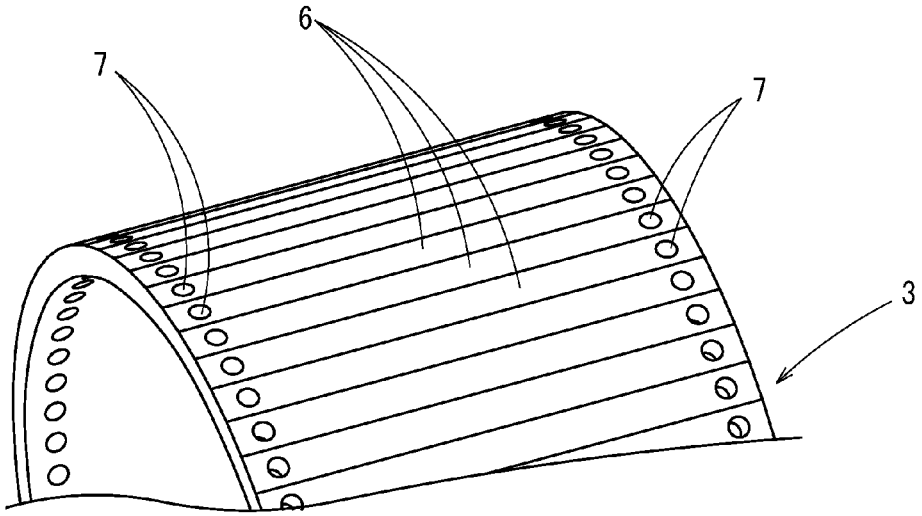
FIG. 2 is a perspective view showing a surface of a roll of the fracturing apparatus of FIG. 1.

In the fracturing apparatus 1, two rolls 3 are arranged in a housing 2 so that rotation axes 4 are arranged horizontally and parallel to each other, and a plurality of fracturing teeth 5 are provided on outer surfaces of the rolls 3 so as to protrude radially-outwardly. The outer surfaces of the rolls 3 are not regular circular arc surfaces, as shown in FIG. 2, but are formed polyhedral in which flat surfaces 6 longitudinal along the axes are connected along circumferential directions. Threaded holes 7 are formed on both ends of the flat surfaces 6. A fracturing teeth unit 8 is fixed on each of the flat surfaces 6.

Figure 3:
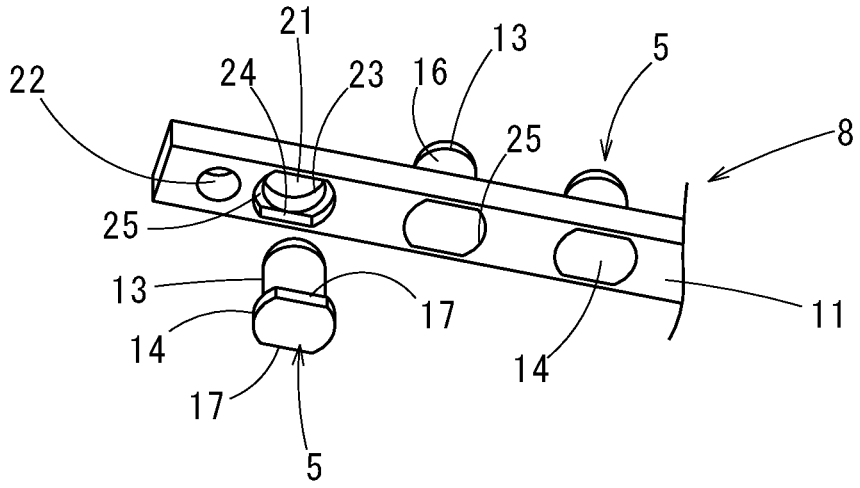
FIG. 3 is a perspective view showing a rear of a fracturing teeth unit attached to the fracturing apparatus.
Figure 4:
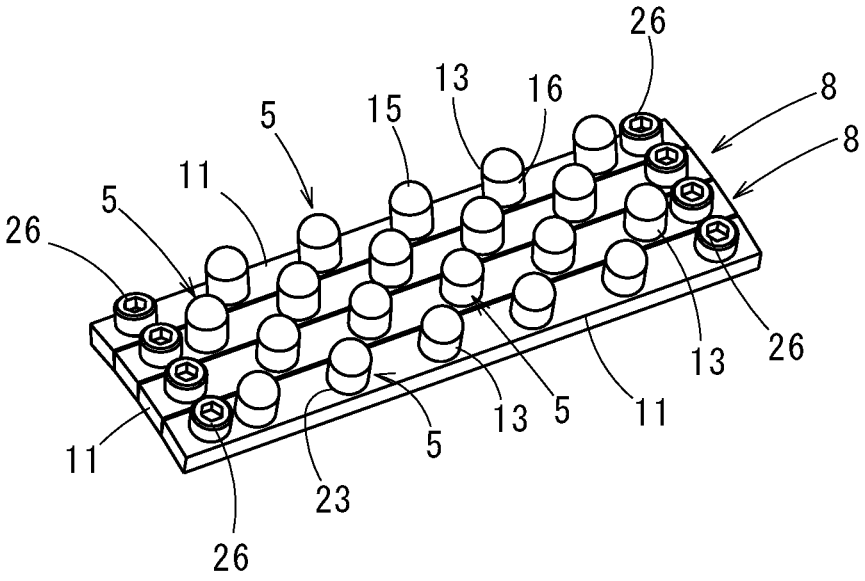
FIG. 4 is a perspective view showing a row of the fracturing teeth units.

The fracturing teeth unit 8 is formed of a fixing cover 11 being in contact with the flat surface 6 of the roll 3 and the plurality of fracturing teeth 5 attached to the fixing cover 11 as shown in FIG. 3 and FIG. 4.

Figure 5:
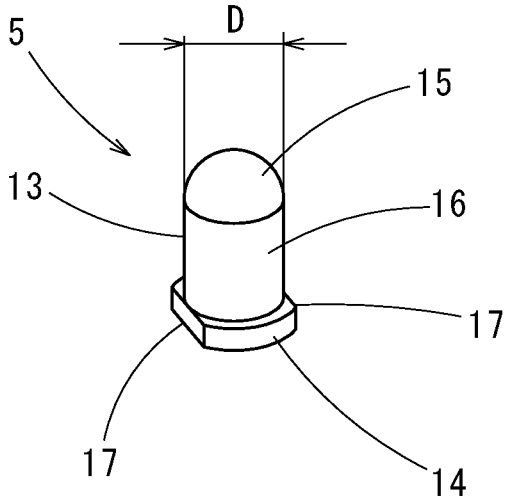
FIG. 5 is a perspective view of the fracturing tooth.

The fracturing tooth 5 is formed integrally by cemented carbide so as to have a columnar part 13 and a flange part 14 expanding in diameter at a basal end of the columnar part 13 as shown in FIG. 5. A top surface 15 of the columnar part 13 is formed spherically; and a side surface 16 of the columnar part 13 is formed conically or cylindrically. The flange part 14 is formed so that both sides of a circular plate are cut parallel to a longitudinal direction of the columnar part 13, so that flat parts 17 are formed in 180° opposite direction from each other by the cut parts.

The fixing cover 11 is formed as a strip having a same width and a same length as that of the flat surface 6 of the roll 3. Fixing holes 21 for fracturing teeth are formed with intervals along a longitudinal direction of the fixing cover 11 so as to penetrate the fixing cover 11. Through-holes 22 for screw are formed at both sides of the fixing cover 11. As shown in FIG. 3, each of the fixing holes 21 is configured with a fit hole 23 and an expanded part 25. The fit hole 23 is formed to a half depth of thickness of the fixing cover 11, and has a circular cross-section corresponding with the side surface 16 of the columnar part 13 of the fracturing tooth 5. The other half depth of the thickness of the fixing cover 11 of the fixing hole 21 is the expanded part 25 having flat parts 24 corresponding to the flange part 14 of the fracturing tooth 5.

When the fracturing tooth 5 is fixed to the fixing cover 11, the flange part 14 of the fracturing tooth 5 is fitted into the expanded part 25 of the fit hole 23 of the fixing cover 11, and the flat parts 17 of the fracturing tooth 5 are in contact with the flat parts 24 of the fixing cover 11. Therefore, the fracturing tooth 5 is fixed to the fixing cover 11 so as not to rotate with respect to the fixing cover 11 by fitting the columnar part 13 into the fit hole 23 of the fixing cover 11.

The fixing cover 11 is laid on each of the flat surfaces 6 of the rolls 3 in a state in which the expanded parts 25 face to the surfaces of the rolls 3 and the columnar parts 13 of the fracturing teeth 5 are protruded from the fit holes 23, and both ends of the fixing cover 11 are fixed to the surfaces of the rolls 3 by screws 26.

The fracturing teeth units 8 are arranged so that the fracturing teeth 5 of the adjacent fracturing teeth units 8 are not rowed along the circumferential direction of the rolls 3, as shown in FIG. 4. That is, the adjacent fracturing teeth units 8 are installed on the rolls 3 so that the fracturing teeth 5 are arranged in a staggered manner.

Figure 6:
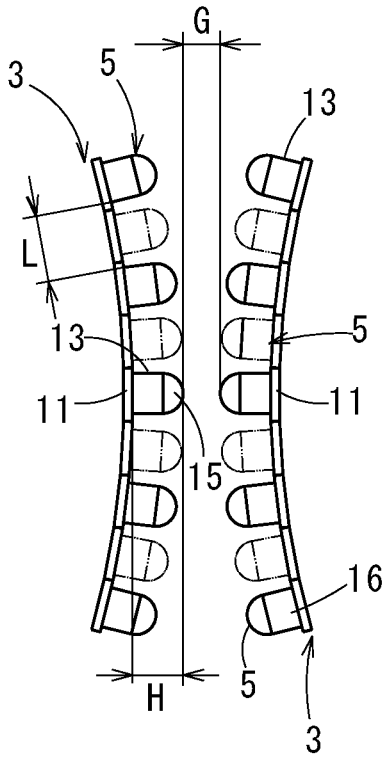
FIG. 6 is a front view showing a positional relation of the rolls at a facing part.
Figure 7:
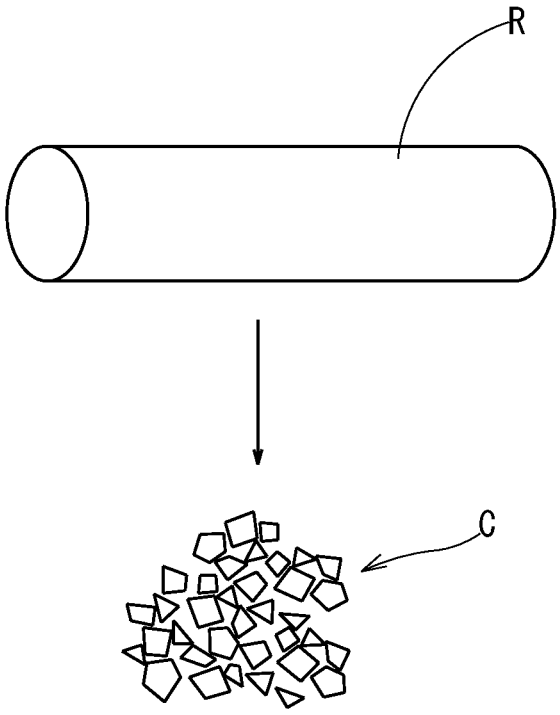
FIG. 7 is a schematic view showing fragments obtained by fracturing a rod of polycrystalline silicon.

On the other hand, between the rolls 3, the fracturing teeth 5 are arranged so that the top surfaces 15 of the fracturing teeth 5 on the rolls 3 face each other at the facing part (i.e., a part in which the fracturing teeth 5 of the rolls 3 closest to each other) as shown in FIG. 6.

In FIG. 6, among the staggered fracturing teeth 5, the fracturing teeth 5 arranged in a same circumferential row are denoted by continuous lines; and the fracturing teeth 5 arranged in the other circumferential row are denoted by two-dot lines.

In the present embodiment, when the fragments of polycrystalline silicon having a maximum length of 110 mm are supplied into the fracturing apparatus 1, the fractured fragments of polycrystalline silicon after fracturing is desired to have the maximum length in a range of equal to or more than 5 mm to equal to or less than 90 mm. In order to obtain the fractured fragments having such a size, each of the fracturing teeth 5 is set to have a diameter D of the columnar part 13 of 14 mm, a protruding height H from the surface of the fixing cover 11 to the tip of the fracturing tooth 5 of 30 mm as shown in FIG. 6; and a distance L between the adjacent fracturing teeth 5 is set to 26 mm. Furthermore, at the facing part of the rolls 3, a facing distance G between the top surfaces 15 of the fracturing teeth 5 is set to 74 to 110 mm. Fracturing ratio which is specified by the maximum length of polycrystalline silicon before fracturing in the fracturing apparatus 1 with respect to the facing distance G is set in a range of equal to or more than 1.0 to less than 1.5.

The housing 2 in which the rolls 3 are set is formed of resin such as polypropylene or the like, or formed of metal having an inner coating of tetrafluoroethylene in order to prevent contamination.

In the housing 2, a pair of partition plates 31 which cross the axes 4 of the rolls 3 are provided at both ends of the rolls 3 with certain intervals with respect to the inner wall surface of the housing 2 so as to be parallel with the inner wall surface of the housing 2. The partition plates 31 are fixed to the housing 2, have two cutouts 32 which are formed by being cut at circular arc shape with slightly larger diameter than that of the rolls 3 so as to engage the half or more of the rolls 3, and are arranged with spanning the rolls 3 in a state in which the cutouts 32 are engaged to the ends of the rolls 3.

In a state in which the partition plates 31 are engaged to the rolls 3, gaps are formed between inner peripheral surfaces of the cutouts 32 of the partition plates 31 and outer peripheral surfaces of the rolls 3 so as not to disturb the rotation of the rolls 3. Also, the screws 26 for fixing the fracturing teeth units 8 which are provided at both the ends of the rolls 3 are positioned outside the partition plates 31 so that space above and below the facing part of the rolls 3 is located between the partition plates 31.

The space between the partition plates 31 is a fracturing space 33 for polycrystalline silicon. On an upper surface of the housing 2, an inlet 34 is formed so as to be arranged immediately above the fracturing space 33. The partition plates 31 are formed also from resin such as polypropylene or the like or metal having inner coating of tetrafluoroethylene, as the housing 2.

The housing 2 is provided with a gearbox or the like (not shown) for rotary-driving the rolls 3. An exhaust system (not shown) is connected to the gearbox so as to exhaust the housing 2 and an inner space of the gearbox.

In the fracturing apparatus 1 constructed as above, when previously roughly-crashed fragments of polycrystalline silicon having appropriate size are supplied into the fracturing space 33 for polycrystalline silicon between the partition plates 31 through the inlet 34 of the housing 2 in a state in which the rolls 3 are rotated, the fragments of polycrystalline silicon are further fractured into fragments between the fracturing teeth 5 of the rolls 3.

In the fracturing teeth 5, the top surfaces 15 are formed spherically, so that the top surfaces 15 and polycrystalline silicon are in contact at points. Also, in the fracturing teeth 5, the side surfaces 16 of the columnar parts 13 are formed conically or cylindrically, so that the side surfaces 16 and polycrystalline silicon are in contact at points or in lines. Therefore, the fracturing teeth 5 impact polycrystalline silicon in a state of being in contact with polycrystalline silicon at points or in lines, so that polycrystalline silicon can be prevented from being crushed by planes.

Since the fracturing ratio is set in the range of equal to or more than 1.0 to less than 1.5, supplied polycrystalline silicon is not excessively ground, so that powder can be prevented from being generated.

The partition plates 31 which are arranged above the ends of the rolls 3 prevent the fragments of polycrystalline silicon which are fractured therebetween from being ground by entering between the inner wall surfaces of the housing 2 and the end surfaces of the rolls 3. Therefore, the fragments of polycrystalline silicon can be reliably fractured and pass through between the rolls 3.

As a result, in the fracturing apparatus 1, polycrystalline silicon can be fractured to of desired size, so that the powder can be prevented from being generated and the loss rate can be reduced.

Next, a method for producing fractured fragments of polycrystalline silicon of a second embodiment according to the present invention will be described.

In the first embodiment of the method for producing, the fracturing process is performed once. In the second embodiment of the method for producing, the fracturing processes are repeated four times.

In first to fourth fracturing processes of the second embodiment, using the same fracturing apparatus 1 as that in the fracturing process of the first embodiment, polycrystalline silicon is fractured between the rolls 3 which are rotated in the counter direction each other around the parallel axes. Furthermore, in the method for producing of the second embodiment, a sorting process sorting the fractured fragments of polycrystalline silicon obtained by the previous process by size is performed between the fracturing processes. The large fractured fragments of polycrystalline silicon sorted by the previous sorting process are fractured in the following fracturing process with adjusting the facing distance G between the fracturing teeth 5 so that the fracturing ratio is in the range of equal to or more than 1.0 to less than 1.5 in accordance with the maximum length of the large fractured fragments.

The facing distances G between the fracturing teeth in the fracturing processes are made smaller as the fracturing process is repeated (that is to say, the number of the fracturing processes is increased), as shown in Table 1. That is, the facing distance G of the latter fracturing process is set smaller than that of the former fracturing process. In the fracturing teeth 5 of the fracturing processes, the diameter D of the columnar part 13, the protruding height H from the surface of the fixing cover 11, and the distance L between the adjacent fracturing teeth are set smaller as the number of fracturing times is increased.

TABLE 1

| NUMBER OF FRACTURING | FRACTURING PROCESS | MAXIMUM LENGTH OF SUPPLIED FRAGMENTS (mm) | FRACTURING TEETH DIAMETER D (mm) | HEIGHT H (mm) | DISTANCE L (mm) | FACING DISTANCE G (mm) | FRACTURING RATIO |
|---|---|---|---|---|---|---|---|
| 1 | 1st | 110 | 14 | 30 | 26 | 74-110 | 1.49-1.0 |
| 2 | 2nd | 90 | 13 | 25 | 22 | 61-90 | 1.48-1.0 |
| 3 | 3rd | 75 | 12 | 20 | 18 | 51-75 | 1.47-1.0 |
| 4 | 4th | 65 | 11 | 15 | 14 | 44-65 | 1.48-1.0 |

When fractured fragments of polycrystalline silicon is produced by using the fracturing apparatus configured as described above, in the first fracturing process, in a state of rolling the rolls 3, fractured polycrystalline silicon having maximum length of not more than 110 mm is supplied. Most of the supplied polycrystalline silicon is fractured into fragments having maximum length of not more than 90 mm by being fractured between the fracturing teeth 5 of the rolls 3, although a small quantity of powder is generated.

Next, the fractured fragments of polycrystalline silicon fractured at the first fracturing process are sorted by size at a sorting process. In the sorting process, for example, the polycrystalline silicon is sorted by size to fractured fragments having maximum length of less than 60 mm and fractured fragments having maximum length of not less than 60 mm by a screen or the like. Then, the sorted fractured fragments in the range of not less than 60 mm and not more than 90 mm are supplied to the fracturing apparatus of a second fracturing process in a state in which the rolls 3 are rotated.

In the second fracturing process, as same as in the first fracturing process, although a small quantity of powder is generated by being fractured between the fracturing teeth 5 of the rolls 3, most of the polycrystalline silicon is fractured to fragments having maximum length of not more than 75 mm. Then, the fragments are sorted by separation equipment, so that the fragments having maximum length of not less than 60 mm and not more than 75 mm are supplied to a third fracturing apparatus (third fracturing process). In this way the fracturing and the sorting are repeated to a fourth fracturing process, so that most of the fragments are generated to have size of 5 to 60 mm.

In the second embodiment, in order to produce the fractured fragments of polycrystalline silicon after fracturing having the maximum length in a range of 5 to 60 mm, the fracturing processes are arranged from the first to the fourth fracturing process in which the facing distance G is set to a range of 44 to 65 mm. Therefore, the fractured fragments are supplied to, from the fracturing apparatuses of the first fracturing process in which the facing distance G is set larger to the fourth fracturing process in which the facing distance G is set smaller in a sequential order, so that the size of the fractured fragments are approached to the desired size by fracturing the fragments gradually. As a result, generation rate of powder can be suppressed and conversion efficiency to the fractured fragments of polycrystalline silicon having the desired size can be improved.

The present invention is not limited to the above-described embodiments and various modifications may be made without departing from the scope of the present invention.

For example, dimensions of the facing distance of the fracturing teeth or the like are not limited to the above-described embodiments.

What is claimed is:

1. A method for producing fractured fragments of polycrystalline silicon comprising a step of fracturing fragments of polycrystalline silicon between a pair of rolls which are rotated in a counter direction each other around parallel axes, wherein:

the rolls have a plurality of fracturing teeth protruding radially-outwardly from outer peripheral surfaces thereof;

the fracturing teeth have semi-spherical top surfaces and conical or cylindrical side surfaces;

the fracturing step is performed in fracturing ratio of equal to or more than 1.0 to less than 1.5, and the fracturing ratio is specified by a maximum length of polycrystalline silicon before fracturing with respect to a facing distance between the top surfaces of the fracturing teeth at a facing part of the rolls.

2. The method for producing fractured fragment of polycrystalline silicon according to claim 1, performing a plurality of the fracturing step; and sorting the fractured fragments of polycrystalline silicon obtained by the fracturing step by size between fracturing steps, wherein the large fractured fragments of polycrystalline silicon sorted by the sorting step are fractured by the fracturing step following the sorting step.

3. The method of producing fractured fragments of polycrystalline silicon according to claim 2, wherein, in each of the fracturing steps, diameters and protruding heights of the fracturing teeth and gaps between the adjacent fracturing teeth are adjusted in accordance with the facing distance of the fracturing teeth.

* * * * *